United States Patent [19]

Kodaira

[11] 4,433,222

[45] Feb. 21, 1984

[54] MINIATURIZED PUSH BUTTON SWITCH

[75] Inventor: Yasuo Kodaira, Tokyo, Japan

[73] Assignee: Nihon Kaiheiki Industrial Company, Ltd., Tokyo, Japan

[21] Appl. No.: 337,113

[22] Filed: Jan. 5, 1982

[30] Foreign Application Priority Data

Jan. 31, 1981 [JP] Japan ..... 56-11646

[51] Int. Cl.[3] ..... H01H 3/46

[52] U.S. Cl. ..... 200/153 J; 200/159 R; 200/254; 200/282

[58] Field of Search ..... 200/153 J, 252, 253, 200/282, 159 R, 254, 160, 73, 67 G

[56] References Cited

U.S. PATENT DOCUMENTS

| | | | |
|---|---|---|---|
| 2,809,246 | 10/1957 | Taylor | 200/67 R |
| 3,233,058 | 2/1966 | Horst | 200/77 |
| 3,378,664 | 4/1968 | Russenberger | 200/160 |
| 3,502,833 | 3/1970 | Rossini et al. | 200/153 J |
| 3,619,528 | 11/1971 | Sorenson | 200/153 J |
| 3,789,173 | 1/1974 | Bury | 200/153 J |
| 3,894,203 | 7/1975 | Diehr | 200/282 |
| 4,371,767 | 2/1983 | Ohashi et al. | 200/254 X |

FOREIGN PATENT DOCUMENTS

| | | | |
|---|---|---|---|
| 1124485 | 10/1956 | France | 200/159 R |
| 232256 | 4/1925 | United Kingdom | 200/159 R |

*Primary Examiner*—John W. Shepperd
*Assistant Examiner*—Renee S. Kidorf
*Attorney, Agent, or Firm*—Burns, Doane, Swecker & Mathis

[57] ABSTRACT

A push button switch comprises a switch body defining an enclosure; a support member disposed within the enclosure, a pivotable converter supported by the support member for pivoting between the first and second positions with respect to an imaginary fulcrum plane; an operator actuable push rod extending through the switch body into the enclosure, the push rod being axially displaceable with respect to a displacement axis and having a converter actuator for pushing against the converter so as to pivot the converter in the direction of the second position thereof when the push rod is displaced from an unactuated limit position; a compression spring disposed between the push rod and the converter for biasing the push rod toward the limit position thereof and the converter toward the first position thereof; and a movable contact member fixedly mounted on the converter such that the movable contact member is displaced into and out of sliding contact with a stationary contact member as the converter is pivoted between first and second positions.

10 Claims, 11 Drawing Figures

FIG. 1
PRIOR ART
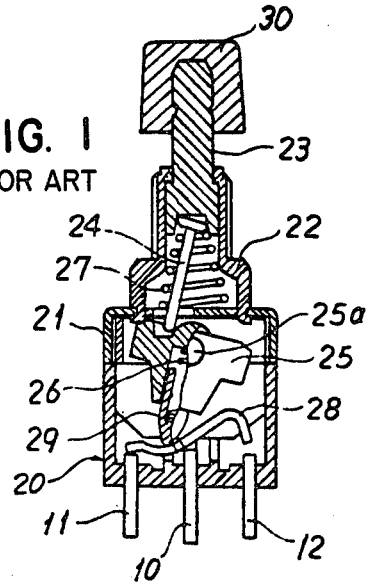
FIG. 2
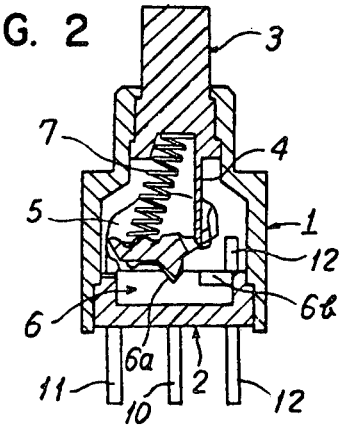
FIG. 3
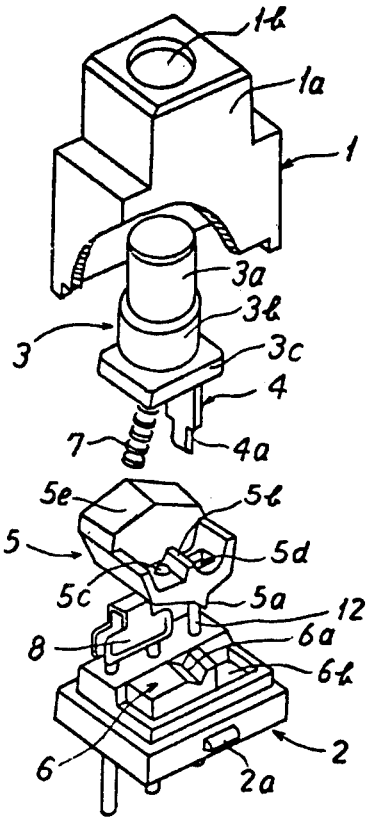
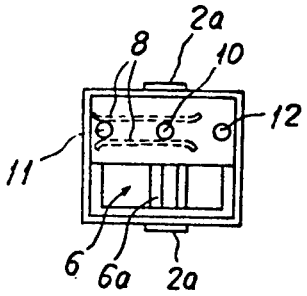
FIG. 4

MINIATURIZED PUSH BUTTON SWITCH

FIELD OF THE INVENTION

The present invention relates in general to switches, and in particular to miniaturized push button mechanical switches.

BACKGROUND OF THE INVENTION

With the increasing miniaturization of all types of electrical apparatus, operating switches for such apparatus must of necessity also be miniaturized. However, such switches must also be responsive to light operator pressure, have a mechanical switching action which has a good "feel" to the operator, and still provide reliable electrical operation.

In one form of conventional miniaturized push button switch, a see-saw contact mechanism is provided. More specifically referring to FIG. 1, a converter 25 is pivotably mounted within a switch body 20 by means of two support shafts 25*a* which project from opposite faces of converter 25 and which are mounted to corresponding inner surfaces of a cover 21 fixedly attached to the open top of switch body 20. An axially slidable push rod 23 having a button 30 on the free end thereof is mounted in a sleeve 22 which projects outwardly from cover 21. A rod-shaped actuator 24 having an enlarged head portion is interposed between push rod 23 and converter 25. The head portion of actuator 24 is inserted in a recess formed in the lower surface of push rod 23, as shown, and the main portion of actuator 24 extends through an orifice in cover 21 into an off-center recess formed in the upper surface of converter 25. A compression spring 27 is disposed around actuator 24 intermediate push rod 23 and switch cover 21. A plunger 29 and a compression spring 26 are disposed in a recess formed in the lower or bottom surface of converter 25 such that displacement of plunger 29 into the recess is resisted by spring 26. Three stationary contact members 10, 11 and 12 extend through the base of switch body 20 and a curvilinear movable contact member 28 is pivotally supported in a see-saw fashion on the central contact member 10 within the enclosure of switch body 20. The distal end of plunger 29 slidably engages the upper surface of movable contact member 28 and is displaceable along the length of contact member 28. As shown, the upper surface of contact member 28 slopes upwardly toward plunger 29 to provide an automatic restoring action to the switch.

In operation, when button 30 and thus push rod 23 is depressed in opposition to the force of spring 27, actuator 24 depresses the upper surface of converter 25, which causes converter 25 to be rotated counterclockwise about a pivot axis defined by shafts 25*a*. Plunger 29 is thus shifted toward contact 12, which causes spring 26 to be compressed. When the lower end of plunger 29 becomes aligned with central contact member 10, movable contact member 28 is rotated quickly clockwise in a see-saw fashion, thereby causing the connection between contacts 11 and 28 to be broken and the connection between contacts 12 and 28 to be closed. As the distal end of plunger 29 is displaced further up the slope of contact member 28, spring 26 is further compressed until reaching its state of maximum compression. When button 30 is released, the force of compressed spring 26 urges plunger 29 down the sloped surface of contact 28, causing converter 25 to be rotated clockwise, and push rod 23 to be pushed up by the force of spring 27, thereby restoring the switch to its original state.

The aforementioned prior art switch has several disadvantages. In addition to having a relatively complicated construction, both the force of spring 27 and the force of spring 26 must be opposed when button 30 is depressed. In addition, the force produced by spring 26 is accentuated because plunger 29 must travel up the sloped surface of contact 28. A large operating force is thus required. Furthermore, the operating force cannot be decreased by weakening the force of spring 26, since the contact pressure thus becomes weakened and the switch contact stability is decreased.

SUMMARY OF THE INVENTION

It is therefore an object of the present invention to provide a miniaturized switch which has a light and comfortable operation without sacrificing contact stability, and which is smaller than the aforementioned prior art switch.

These and other objects are obtained in accordance with the present invention by a switch which utilizes a "sliding type" movable contact arrangement instead of a see-saw type movable contact member. More specifically, a switch constructed in accordance with the present invention comprises a switch body defining an enclosure; support apparatus disposed within the enclosure; a pivotable converter supported by the support apparatus for pivoting between first and second positions with respect to an imaginary fulcrum plane; an operator actuable push rod extending through the switch body into the enclosure, the push rod being axially displaceable with respect to a displacement axis and having a converter actuator for pushing against the converter so as to pivot the converter in the direction of the second position when the push rod is displaced from an unactuated limit position; a compression spring disposed between the push rod and the converter for biasing the push rod toward the limit position thereof and the converter toward the first position thereof; and a movable contact member fixedly mounted on the converter such that the movable contact member is displaced into and out of sliding contact with the stationary contact member as the converter is pivoted between the first and second positions thereof.

In accordance with a further aspect of the invention, a projection is formed on one of the converter and the support apparatus and a depression is formed in the other one of the converter and support apparatus for cooperating with the projection such that the converter pivotably engages the support apparatus.

Preferably, the push rod has a base which is spaced from the converter, and the actuator comprises an elongated member which depends from the push rod base and pushes against the converter at a location spaced from the fulcrum plane in the direction of the converter second position. Further, the spring is preferably mounted at a first end to the push rod base at the center thereof and is mounted at a second end to the converter at a location spaced from the fulcrum plane in the direction of the converter first position.

In accordance with a still further aspect of the invention, the support member is resilient and is pivotably engaged at a central location thereon by the converter. The support member is of such resilience that when the converter reaches a pivot position intermediate the first and second converter positions as the push rod is depressed, the force of the spring on the resilient support member causes the central location thereof to shift from a raised position to a lower position with respect to the push rod, thereby producing a snap-action switching effect.

These and other features and advantages of the present invention are disclosed in or apparent from the following detailed description of preferred embodiments.

BRIEF DESCRIPTION OF THE DRAWINGS

The preferred embodiments will be described with reference to the drawings, in which like elements have been denoted with like reference numerals.

FIG. 1 is a sectional front elevation view of a prior art switch.

FIG. 2 is a sectional front elevation view of a first embodiment of a switch constructed in accordance with the present invention.

FIG. 3 is an exploded perspective view of the switch illustrated in FIG. 2.

FIG. 4 is a bottom plan view of the switch illustrated in FIG. 2.

DETAILED DESCRIPTION OF THE PREFERRED EMBODIMENTS

Referring to FIGS. 2 through 5, a switch constructed in accordance with the present invention comprises a switch body 1 mounted on a base plate 2. Switch body 1 advantageously is formed with depressions (not shown) which cooperate with projections 2*a* on the front and rear surfaces of base plate 2 to provide a snap fit mounting of switch body 1 to base plate 2. Switch body 1 has an upper portion 1*a* which is decreased in width with respect to the rest of switch body 1 and which has a centrally located circular opening 1*b* located in the upper surface of body portion 1*a*. An axially displaceable push rod 3 is inserted through opening 1*b*. Push rod 3 has a cylindrical upper portion 3*a*, a cylindrical lower portion 3*b* which is larger than upper portion 3*a*, and a base plate portion 3*c* extending from the bottom of lower portion 3*b*. The interior of switch body portion 1*a* is configured so as to define downwardly facing step surfaces which abut the corresponding upwardly facing step surfaces defined by the junctions of push rod portions 3*a* and 3*b* and portions 3*b* and 3*c*, respectively, and thereby define an upper limit position of push rod 3 when mounted in switch body 1.

Figure 7:
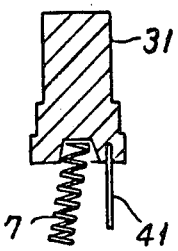
FIG. 7 is a sectional front elevation view of a first exemplary modification of the push rod and actuator portion of the switch illustrated in FIG. 2.
Figure 8:
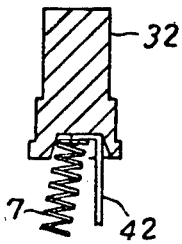
FIG. 8 is a sectional front elevation view of a second exemplary modification of the push rod and actuator portion of the switch illustrated in FIG. 2.
Figure 9:
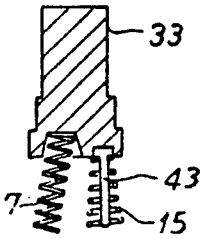
FIG. 9 is a sectional front elevation view of a third exemplary modification of the push rod and actuator portion of the switch illustrated in FIG. 2.

A compression spring 7 has one end inserted into a centered recess formed in the bottom surface of push rod 3. A planar actuator member 4 depends from the bottom surface of push rod 3 in alignment with the right-hand side of the recess receiving compression spring 7 and parallel to the displacement axis of push rod 3. It will thus be appreciated that member 4 is spaced from the push rod displacement axis. In the embodiment of FIG. 2, actuator member 4 is formed integrally with push rod 3. The distal end of actuator member 4 forms a pawl 4*a*. As shown in FIGS. 7–9, separated elements having various mounting configurations, which have been denoted 41, 42 and 43 in the respective figures, advantageously constitute actuator member 4.

Figure 6:
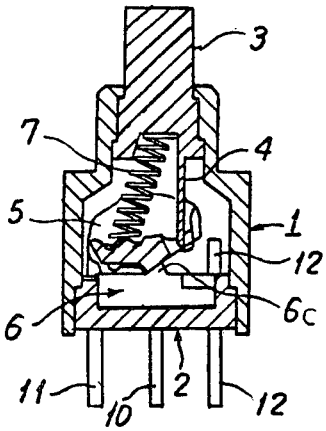
FIG. 6 is a sectional front elevation view of a modified form of the switch illustrated in FIG. 2.

A converter 5 pivotably rests within switch body 1 on a bearing member 6 which is mounted in a recess formed in the front half portion of the upper surface of base plate 2. Advantageously, as shown a triangular projection 5*a*, which depends from the front half portion of the lower surface of converter 5 and is centered between the right and left sides of the converter, is seated in a triangular depression 6*a* formed in the front half portion of the upper surface of bearing member 6 laterally centered between the right and left sides, such that converter 5 pivotably engages bearing member 6 and is pivotable right and left with respect to the vertex of depression 6*a*. Alternatively, as is shown in FIG. 6, the relation between the projection and depression may be reversed, i.e., a depression may be provided in the lower surface of converter 5 and a projection 6*c* may be provided on the upper surface of bearing member 6.

The front half portion of the upper surface of converter 5 is formed with right and left recesses separated by an intermediate rib 5*b*, a button projection 5*c* is formed in the bottom of the left recess, and a hole 5*d* is formed in the bottom of the right recess. The lower end of spring 7 is disposed around projection 5*c*, and hole 5*d* receives pawl 4*a* of actuator 4. The right hand side of the front half portion of the upper surface of bearing member 6 is formed with a stepped lower surface 6*b* which provides clearance for pawl 4*a* when converter 5*a* rocks to the right. Advantageously, hole 5*d* has a narrow right to left width and actuator 4 is made suitably resilient. Further, it will be appreciated that instead of providing a separate bearing member 6, the upper surface of switch plate 2 can have the same configuration as the upper surface of bearing member 6.

A dual-pronged clip-shaped resilient contact member 8 is fixedly mounted in a recess formed in the bottom surface of the rear half portion 5*e* of converter 5 such that the prongs of member 8 depend downwardly and are oriented right to left. Three stationary contact members 10, 11 and 12 are mounted in the rear half portion of base plate 2 such that portions of each contact member project from the upper and lower surface of base plate 2. The upper portions of contact members 10, 11 and 12 are aligned with contact member 8 such that the prongs of member 8 resiliently embrace central contact member 10 and either the end contact member 11 or the end contact member 12 depending on the orientation of converter 5. Advantageously, in order to facilitate the make and break actions of contact member 8 with contact members 11 and 12, the bottom and the right and left edges of the contact member 8 prongs are slightly flared. Further, the lower surface of converter 5 is advantageously provided with small projections 5*f* at the right and left sides thereof. It will be appreciated that the projections 5*f* cooperate with bearing member 6 to limit the degree of rotation of converter 5. It will also be appreciated that although circular embodiments of contact members 10, 11 and 12 have been shown, square or rectangular cross-section embodiments may also be employed.

Figure 5:
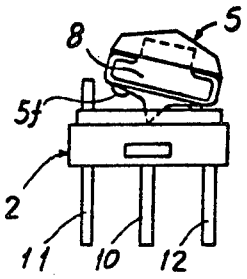
FIG. 5 is a rear elevation view of a portion of the switch illustrated in FIG. 2.

In operation, when push rod 3 is depressed, spring 7 is compressed and the lower end of actuator pawl 4*a* either enters or has entered hole 5*d*. When the stepped transition surface defining the beginning of pawl 4*a* engages the upper surface of converter 5 surrounding hole 5*d*, converter 5 is rotated clockwise toward the right as push rod 3 is further depressed. Since member 8 is disposed above the converter pivot axis defined by projection 5*a* and depression 6*a*, as is shown in FIG. 5, contact member 8 is thus arcuately displaced to the right from the position shown in FIG. 4 and ultimately reaches the position wherein electrical contact between contact members 10 and 11 is broken and electrical contact between contact members 10 and 12 is established. When push rod 3 is released, spring 7 raises push rod 3 to its original position. It will be appreciated that contact is made and broken between contact member 8 and members 11 and 12 by sliding contact of the members.

Referring to FIGS. 7 through 9, three modifications of push rod 3 and actuator 4 will be described. In the embodiment shown in FIG. 7, actuator 41 has the same shape as actuator 4, but is separately formed from push rod 31 and is fixedly mounted in a recess formed in the base of push rod 31. In the embodiment of FIG. 8, the upper end of actuator 42 is bent into an "L" shape and is inserted into the recess formed in the lower surface of push rod 32 for receiving spring 7, and is retained in the recess under compression by the upper end of spring 7. With this construction, when the lower end of actuator 42 engages the recess surface of converter 5, actuator 42 is slightly rotatable counterclockwise to overcome the force of spring 7. In the embodiment of FIG. 9, an actuator 43 is formed in the shape of a pin with a head which is inserted into a corresponding recess formed in the right hand side of the bottom surface of push rod 33. In order to retain actuator 43 in position, a weak coil spring 15 advantageously is disposed around actuator 43 between the lower surface of the head of actuator 43 and the upper surface of converter 5. It will also be appreciated that hole 5*d* may be omitted from converter 5 and the lower end of actuator 4 can be configured to directly engage the right hand recess formed in the upper surface of converter 5.

Figure 10:
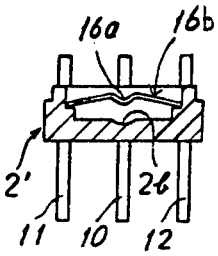
FIG. 10 is a sectional front elevation view of a first exemplary modification of the bearing member portion of the switch illustrated in FIG. 2.
Figure 11:
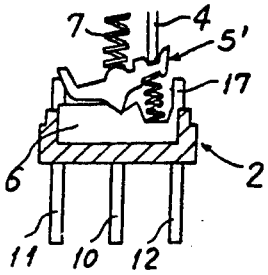
FIG. 11 is a sectional front elevation view of a second exemplary modification of the bearing member portion of the switch illustrated in FIG. 2.

Referring to FIGS. 10 and 11, modifications of support member 6 will now be described. In the embodiment of FIG. 10, member 6 is in the form of a resilient member 16. As shown, member 16 advantageously has an angular planar configuration defining a central recess 16*a* for receiving and supporting the apex of projection 5*a* on the lower surface of converter 5, and two oppositely directed and downwardly inclined legs 16*b*, the distal ends of which abut corresponding interior walls of switch body 20. A recess 2*b* is formed in base plate 2 such that recess 16*a* is free standing within switch body 20, as shown in FIG. 10, when push rod 3 is in the normal position thereof, as shown in FIG. 2. The resilience of bearing member 16 is such that 16 maintains a position wherein recess 16*a* remains spaced from plate member 2 as push rod 3 is depressed, until converter 5 reaches the substantially central pivot position, at which point bearing member 16 collapses, causing recess 16*a* to come into contact with plate member 2. It will thus be appreciated that this embodiment provides snap action switching.

In the embodiment of FIG. 11, the lower end of spring 7 is disposed centrally between the right and left hand sides of converter 5. Accordingly, projection 5*c* for supporting the lower end of spring 7 is shifted to a corresponding central position. Since spring 7 is centrally positioned, converter 5 is stable at both a leftwardly inclined and a rightwardly inclined position, and when converter 5 is pivoted either to the left or the right, a snap action is obtained as it passes through the central pivot position. In order to automatically restore the push rod 3 to its uppermost position after the force depressing push rod 3 has been removed, a spring 17 advantageously is disposed between the right side of converter 5 and the recess 6*b* on the right side of the upper surface of bearing member 6.

As a further modification, the right half portion of the lower surface of bearing member 6 may be slightly cut away such that bearing member 6 is pivotable in one direction between an upright position and an inclined position and thus, when converter 5 passes through the central position, bearing member 6 also inclines suddenly in the same direction, thereby obtaining a click feeling. It will be appreciated that the lateral dimensions of this emmbodiment of bearing member 6 must be such as to provide sufficient clearance between member 6 and the side walls of base plate 2 to allow pivoting of member 6.

Further, it will be appreciated that although the embodiments shown and described are double throw type switches, they may be readily changed to single throw operation of either the normally open or normally closed type. Further, the contact assembly shown in FIG. 3 may be provided in both the front and rear half portions, such that a multipoled-switch can be easily obtained.

It will be appreciated that by providing a sliding contact between movable contact member 8 and the stationary contact members, switch bounce due to collision at the time of switching of the contacts is eliminated, and a self-cleaning action of the respective contacts is also provided. Further, since only one coil spring is as a general rule required, the force necessary to operate the switch is relatively small and the height of the switch can be reduced significantly. By positioning the center of rotation of the converter at its central portion, a light and comfortable switching action is obtained as well as a reduction in the switch height.

I claim:

1. A push button switch comprising a switch body defining an enclosure;

support surface means disposed within said enclosure;

a pivotable converter disposed above and supported by said support surface means, one of said converter and said support surface means having a projection formed thereon and the other one of said converter and said support surface means having a depression formed therein for cooperating with said projection such that said converter pivotably engages said support surface means and is pivotable between first and second positions with respect to an imaginary fulcrum plane, said projection and said depression defining a pivot joint and a pivot axis;

an operator actuable push rod extending through said switch body into said enclosure with a base which is spaced from said converter, said push rod being axially displaceable with respect to a displacement axis and having a depending, elongated converter actuator spaced from and substantially parallel to said displacement axis for pushing against said converter at a single predetermined location thereon so as to pivot said converter in the direction of said second position when said push rod is displaced from an unactuated limit position;

compression spring means disposed between said push rod and said converter for biasing said push rod toward said limit position and said converter toward said support surface means;

three spaced stationary contact members aligned in a row, said row extending transversely with respect to said fulcrum plane and being axially spaced from said pivot joint with respect to said pivot axis; and an elongated movable contact member fixedly mounted on said converter relatively above said pivot axis and in relative alignment with said stationary contact members such that said movable contact member bridges the central one of said stationary contact members and is arcuately displaced into and out of sliding contact with the respective end ones of said stationary contact members as said converter is pivoted between said first and second positions.

2. The switch of claim 1 wherein said projection and said depression are triangularly shaped.

3. The switch of claim 1 wherein said predetermined location is on a first side of said fulcrum plane in the direction of said converter second position, and said spring means is mounted at a first end to said push rod base at the center thereof and is mounted at a second end to said converter at a location spaced from said fulcrum plane on a second side thereof in the direction of said converter first position, such that said converter is biased toward said first position.

4. The switch of claim 3 wherein said converter is formed with an actuator recess which receives said actuator.

5. The switch of claim 4 wherein said push rod base is formed with a recess which receives said spring means first end, and said converter is formed with a spring recess having a bottom projection and said spring means second end is received by said spring recess in engagement with said bottom projection.

6. The switch of claim 1 wherein said support surface means comprises resilient means which is pivotably engaged at a central location thereon by said converter and which is of such resilience that when said converter reaches a pivot position intermediate said first and second positions as said push rod is depressed, the force of said spring means on said resilient means causes said resilient means central location to shift from a raised position to a lower position with respect to said push rod, thereby producing a snap-action switching effect.

7. The switch of claim 6 wherein said resilient means comprises an angular planar resilient member defining a depression at said central location and first and second oppositely directed and downwardly inclined legs, the distal ends of which abut corresponding interior walls of said switch body.

8. The switch of claim 1 wherein said displacement axis of said push rod and said fulcrum plane are substantially coplanar and said spring means extends substantially coaxially between said push rod and said converter with respect to said displacement axis, such that said converter snaps into said first or second position when said converter is pivoted from the other position and reaches a central pivot position intermediate said first and second position.

9. The switch of claim 8 further comprising second spring means disposed between said converter and said support surface means such that said converter is biased toward said first position.

10. The switch of claim 1 wherein said movable contact member has two spaced resilient legs which engage said stationary contact members with a clipping action when said movable and stationary contact members are in contact.

* * * * *